US012668748B2

(12) United States Patent
Jadaun et al.

(10) Patent No.: US 12,668,748 B2
(45) Date of Patent: Jun. 30, 2026

(54) PROCESS FOR CONVERTING OLEFINS TO JET FUEL

(71) Applicant: UOP LLC, Des Plaines, IL (US)

(72) Inventors: Krishan Pratap Jadaun, Gurugram (IN); Vikrant Vilasrao Dalal, Gurugram (IN); Stanley Joseph Frey, Palatine, IL (US); Arunim Bose, Gurugram (IN); Richa Sharma, Gurugram (IN)

(73) Assignee: UOP LLC, Rosemont, IL (US)

( * ) Notice: Subject to any disclaimer, the term of this patent is extended or adjusted under 35 U.S.C. 154(b) by 215 days.

(21) Appl. No.: 18/401,398

(22) Filed: Dec. 30, 2023

(65) Prior Publication Data

US 2024/0218268 A1 Jul. 4, 2024

Related U.S. Application Data

(60) Provisional application No. 63/478,496, filed on Jan. 4, 2023.

(51) Int. Cl.
*C10G 57/02* (2006.01)

(52) U.S. Cl.
CPC ..... *C10G 57/02* (2013.01); *C10G 2300/1088* (2013.01); *C10G 2400/08* (2013.01)

(58) Field of Classification Search
CPC ..... C10G 57/02; C10G 2300/1088; C10G 2400/08; C10G 50/00; C10G 69/126
USPC ..... 585/518, 251
See application file for complete search history.

(56) References Cited

U.S. PATENT DOCUMENTS

| | | | | |
|---|---|---|---|---|
| 9,663,416 | B2 | 5/2017 | Lilga et al. | |
| 10,815,439 | B2 | 10/2020 | Ho et al. | |
| 2015/0148572 | A1 | 5/2015 | Xu et al. | |
| 2015/0344382 | A1* | 12/2015 | Eizenga | C07C 1/2078 422/187 |
| 2016/0194572 | A1* | 7/2016 | Lilga | C07C 2/24 585/277 |
| 2016/0312131 | A1 | 10/2016 | Luebke et al. | |
| 2023/0340335 | A1 | 10/2023 | Beato | |

OTHER PUBLICATIONS

Search Report and Written Opinion for PCT/US2024/010104 dated May 2, 2024.

* cited by examiner

*Primary Examiner* — Prem C Singh
*Assistant Examiner* — Francis C Campanell
(74) *Attorney, Agent, or Firm* — Paschall & Associates, LLC; James C. Paschall

(57) ABSTRACT

A process for dimerizing and oligomerizing olefins to distillate fuels which subjects oligomerized product to hydrocracking and hydroisomerization in a single reactor to convert heavier oligomers to jet fuel range oligomers. A jet fuel product stream may be taken from a side of a stripping column which produces a heavy drag stream from a bottom of the stripping column to ensure an end point boiling specification is achieved.

20 Claims, 3 Drawing Sheets

PROCESS FOR CONVERTING OLEFINS TO JET FUEL

FIELD

The field is the conversion of olefins to distillate. The field may particularly relate to dimerizing olefins and oligomerizing the dimerized olefins to distillate fuels.

BACKGROUND

Ethylene can be dimerized and oligomerized into olefins such as C4, C6 and C8 olefins. Olefin oligomerization is a process that can oligomerize smaller olefins into larger olefins. More specifically, it can convert olefins including dimerized olefins into a distillates including jet fuel and diesel range products. The oligomerized distillate can be saturated for use as transportation fuels.

The dimerization reaction of ethylene is highly exothermic. The exotherm generated by ethylene dimerization can be difficult to manage.

Jet fuel is one of the few petroleum fuels that cannot be replaced easily by electrical motor systems because a high energy output is required to fuel planes which cannot be supplied with electric motors. Jet fuel has an end point boiling specification of less than 300° C. using ASTM D86. Large incentives are currently available for green jet fuel in certain regions.

Hydroprocessing can include processes which convert hydrocarbons in the presence of hydroprocessing catalyst and hydrogen to more valuable products. Hydrotreating or hydrogenation is a process in which hydrogen is contacted with hydrocarbons in the presence of hydrotreating catalysts which are primarily active for the removal of heteroatoms, such as sulfur, nitrogen, oxygen and metals from the hydrocarbon feedstock. In hydrotreating, hydrocarbons with double and triple bonds such as olefins may be saturated.

Hydrocracking is a hydroprocessing process in which hydrocarbons crack in the presence of hydrogen and hydrocracking catalyst to lower molecular weight hydrocarbons. Depending on the desired output, a hydrocracking unit may contain one or more beds of the same or different catalyst. Hydroisomerization is a hydroprocessing process which increases the number of alkyl groups on a hydrocarbon chain.

An efficient process is desired for converting ethylene to distillate fuels.

BRIEF SUMMARY

We have formulated a process for dimerizing and oligomerizing olefins to distillate fuels which cracks and isomerizes larger diesel range oligomers into jet fuel range molecules. The use of concurrent cracking and isomerizing in a single reactor to improve the jet fuel properties and bring larger oligomers into the jet fuel boiling range may be optimal. A jet fuel product stream may be taken from a side of a stripping column which produces a heavy drag stream from a bottom of the stripping column to ensure an end point boiling specification is achieved.

DEFINITIONS

Figure 1:
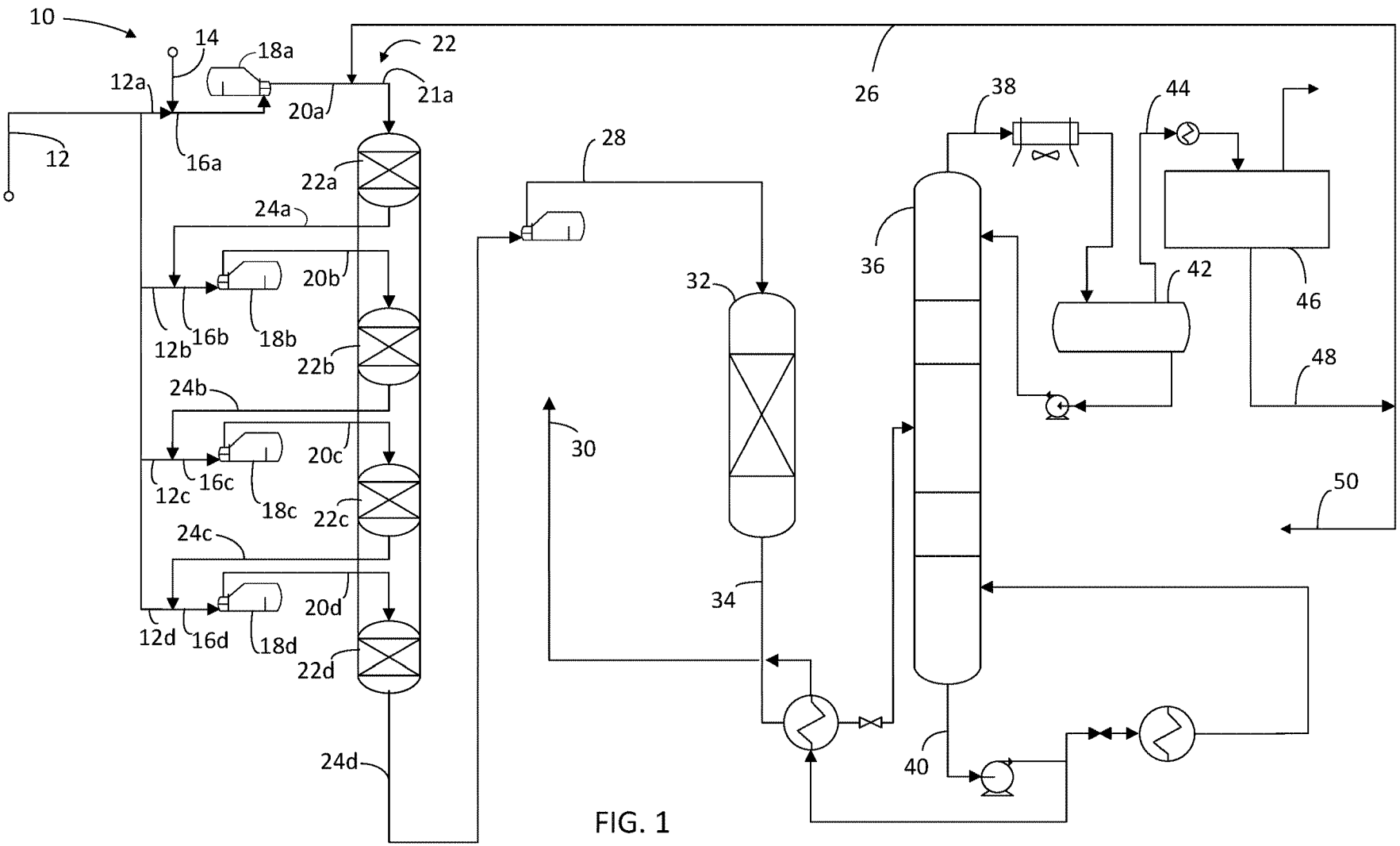
FIG. 1 is a schematic drawing of an oligomerization section of a process and apparatus of the present disclosure.

The term "communication" means that fluid flow is operatively permitted between enumerated components, which may be characterized as "fluid communication".

The term "downstream communication" means that at least a portion of fluid flowing to the subject in downstream communication may operatively flow from the object with which it fluidly communicates.

The term "upstream communication" means that at least a portion of the fluid flowing from the subject in upstream communication may operatively flow to the object with which it fluidly communicates.

The term "direct communication" means that fluid flow from the upstream component enters the downstream component without passing through any other intervening vessel.

The term "indirect communication" means that fluid flow from the upstream component enters the downstream component after passing through an intervening vessel.

The term "bypass" means that the object is out of downstream communication with a bypassing subject at least to the extent of bypassing.

As used herein, the term "predominant" or "predominate" means greater than 50%, suitably greater than 75% and preferably greater than 90%.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripping columns may omit a reboiler at a bottom of the column and instead provide heating requirements and separation impetus from a fluidized inert media such as steam. Stripping columns typically feed a top tray and take main product from the bottom.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure. As used herein, the term "boiling point temperature" means atmospheric equivalent boiling point (AEBP) as calculated from the observed boiling temperature and the distillation pressure, as calculated using the equations furnished in ASTM D1160 appendix A7 entitled "Practice for Converting Observed Vapor Temperatures to Atmospheric Equivalent Temperatures".

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "T5", "T90" or "T95" means the temperature at which 5 mass percent, 90 mass percent or 95 mass percent, as the case may be, respectively, of the sample boils using ASTM D-86 or TBP.

As used herein, the term "initial boiling point" (IBP) means the temperature at which the sample begins to boil using ASTM D-7169, ASTM D-86 or TBP, as the case may be.

As used herein, the term "end point" (EP) means the temperature at which the sample has all boiled off using ASTM D-7169, ASTM D-86 or TBP, as the case may be.

As used herein, the term "diesel" means hydrocarbons boiling in the range of an IBP between about 125° C. (257° F.) and about 175° C. (347° F.) or a T5 between about 150° C. (302° F.) and about 200° C. (392° F.) and the "diesel cut point" comprising a T95 between about 343° C. (650° F.) and about 399° C. (750° F.) using the TBP distillation method or a T90 between 280° C. (536° F.) and about 340° C. (644° F.) using ASTM D-86. The term "green diesel" means diesel comprising hydrocarbons not sourced from fossil fuels.

As used herein, the term "jet fuel" means hydrocarbons boiling in the range of a T10 between about 190° C. (374° F.) and about 215° C. (419° F.) and an end point of between about 290° C. (554° F.) and about 310° C. (590° F.). The term "green jet fuel" means jet fuel comprising hydrocarbons not sourced from fossil fuels.

DETAILED DESCRIPTION

The process disclosed involves dimerizing an olefin stream comprising ethylene followed by further oligomerizing the ethylene dimers and ethylene oligomers. The process utilizes a hydrocracking reactor as a jet fuel optimization reactor to crack and hydroisomerize larger oligomers into the jet fuel range. The process and apparatus may include an oligomerization section 10 in FIG. 1 and a hydroprocessing section 80 in FIG. 2.

Figure 2:
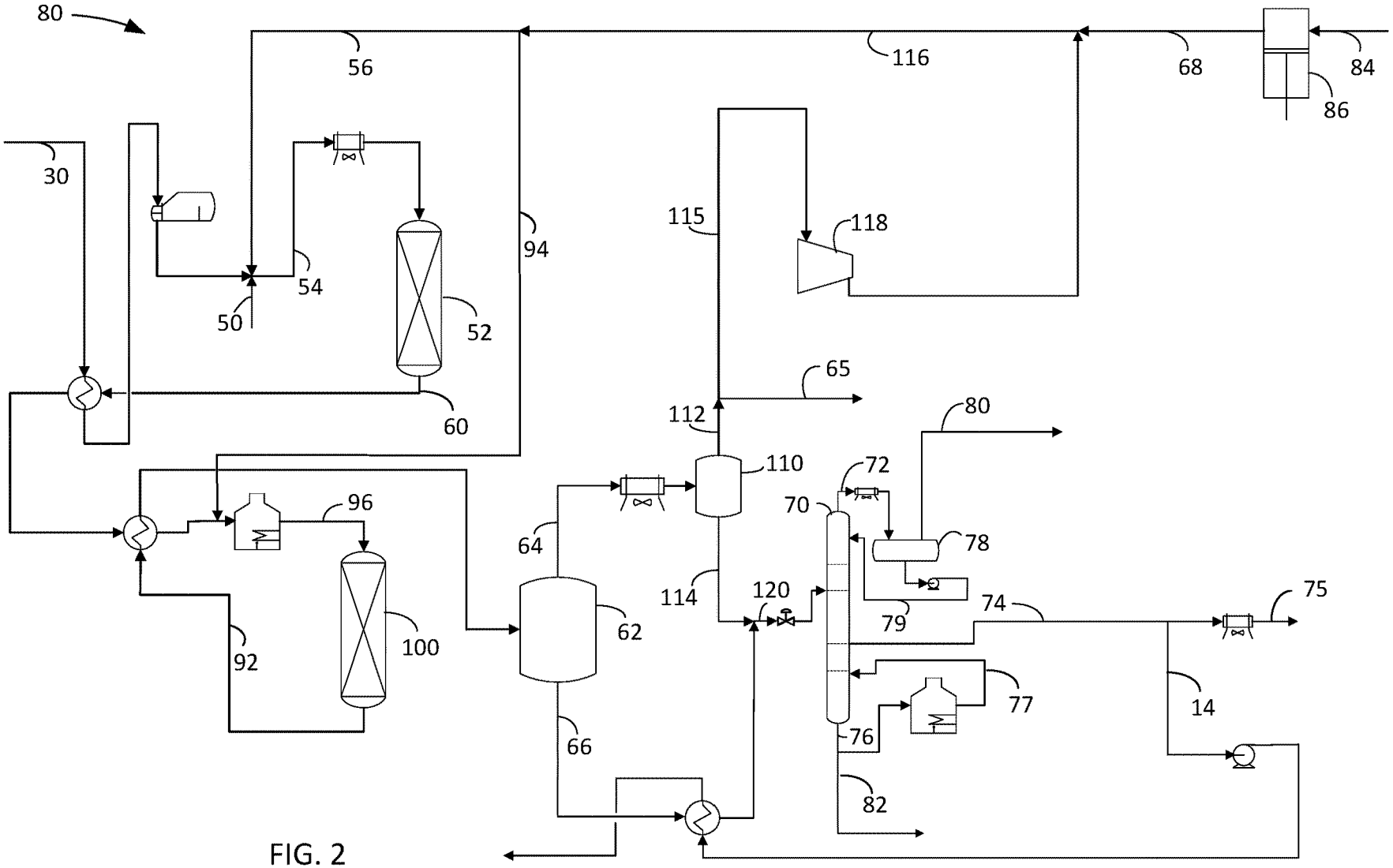
FIG. 2 is a schematic drawing of a hydrogenation section of a process and apparatus of the present disclosure.

Turning to the hydroprocessing section 80 in FIG. 2, the heavy oligomerized olefin stream in the net olefin splitter bottoms line 30 from FIG. 1 comprising distillate-range C8+ oligomerized olefins may be hydrogenated to saturate the olefinic bonds in a hydrogenation reactor 52 to provide fuels. This step is performed to ensure the product motor fuel meets or exceeds the thermal oxidation requirements specified in ASTM D7566-10a for hydroprocessed synthesized paraffinic kerosene (SPK). Additionally, saturating the heavy oligomerized olefins will provide the paraffin stream that may be used as the diluent stream in line 14.

The heavy oligomerized olefin stream in line 30 may be cooled by heat exchange with the hydrogenated stream in line 60 and cooled in a first steam generator to produce steam and be combined with a hydrogenation hydrogen stream in line 56 to produce a combined oligomerization hydrogenation charge stream in line 54. The light olefin drag stream comprising C2 to C7 olefins in line 50 also from FIG. 1 may also be combined with the heavy oligomerized olefin stream in line 30 to produce the combined oligomerization hydrogenation charge stream in line 54. The combined oligomerization hydrogenation charge stream in line 54 may be cooled and charged to the hydrogenation reactor 52 at about 125° C. (257° F.) to about 250° C. (482° F.) and about 3.5 MPa (500 psig) to about 6.9 MPa (1000 psig). Alternatively, the combined oligomerization hydrogenation charge stream in line 54 is not cooled before it is charged to the hydrogenation reactor 52. An excess of hydrogen may be employed to ensure complete saturation such as about 1.5 to about 2.5 of stoichiometric hydrogen.

Hydrogenation is typically performed using a conventional hydrogenation or hydrotreating catalyst, and can include metallic catalysts containing, e.g., palladium, rhodium, nickel, ruthenium, platinum, rhenium, cobalt, molybdenum, or combinations thereof, and the supported versions thereof. Catalyst supports can be any solid, inert substance including, but not limited to, oxides such as silica, alumina, titania, calcium carbonate, barium sulfate, and carbons. The catalyst support can be in the form of powder, granules, pellets, or the like.

In an exemplary embodiment, hydrogenation is performed in the hydrogenation reactor 52 that includes a platinum-on-alumina catalyst, for example about 0.5 wt % to about 0.9 wt % platinum-on-alumina catalyst. By contact with hydrogenation catalyst in the presence of hydrogen, the hydrogenation reactor 52 converts the olefins into a paraffin product having the same carbon number distribution as the olefins, thereby forming distillate-range paraffins suitable for use as jet and diesel fuel.

The saturated heavy oligomerized stream discharged from the hydrogenation reactor 52 in line 60 may be cooled by heat exchange with the heavy oligomerized olefin stream in line 30 and heated by heat exchange with a cracked stream in line 92. The heated saturated heavy oligomerized stream is combined with a hydrocracking hydrogen stream in line 94 to provide a combined saturated heavy oligomerized olefin stream in line 96 and heated to cracking temperature in a fired heater to provide a heated combined saturated heavy oligomerized olefin stream. The heated combined saturated heavy oligomerized olefin stream in line 96 is charged to a hydrocracking reactor, i.e. a jet fuel optimization reactor 100.

The hydrocracking reactor, i.e. a jet fuel optimization reactor 100 may be a fixed bed reactor that comprises a single vessel with single or multiple catalyst beds in the vessel, and various combinations of hydrocracking catalyst and hydroisomerization catalyst in one or more beds. The hydrocracking reactor, i.e. a jet fuel optimization reactor 100 may be operated in a conventional continuous gas phase over a fixed bed or beds of catalyst. In an aspect, the reactor is operated in a downflow fashion. Both hydroisomerization and hydrocracking reactions occur within the jet fuel optimization reactor. Hydroisomerization optimizes fuel properties including freeze point, while hydrocracking optimizes freeze point and yield of jet fuel.

The heated combined saturated heavy oligomerized olefin stream in line 96 is hydrocracked over a hydrocracking catalyst in at least one hydrocracking catalyst bed in the hydrocracking reactor, i.e., a jet fuel optimization reactor 100 in the presence of a hydrocracking hydrogen stream from a hydrocracking hydrogen line 94 to provide a hydrocracked stream in line 92.

The hydrocracking reactor, i.e., a jet fuel optimization reactor may provide a total conversion of at least about 20 vol % and typically greater than about 60 vol % of the heated combined saturated heavy oligomerized olefin stream in the heated hydrocracking charge line 96 to products boiling in the jet fuel range. Diesel boiling paraffins comprising C18+ hydrocarbons crack to jet boiling paraffins comprising C8 to C16 hydrocarbons. The hydrocracking reactor, i.e. a jet fuel optimization reactor 100 may operate at partial conversion of more than about 30 vol % or full conversion of at least about 90 vol % of the feed based on total conversion. The hydrocracking reactor, i.e., a jet fuel optimization reactor

100 may be operated at mild hydrocracking conditions which will provide about 20 to about 60 vol %, preferably about 20 to about 50 vol %, total conversion of the hydrocracking charge stream to product boiling in the jet fuel range.

The hydrocracking catalyst may utilize amorphous silica-alumina bases or zeolite bases combined with one or more Group VIII or Group VIB metal hydrogenating components to selectively produce a balance of light diesel and jet fuel distillate. In another aspect, a catalyst which comprises, in general, any crystalline zeolite cracking base upon which is deposited a Group VIII metal hydrogenating component may be suitable. Additional hydrogenating components may be selected from Group VIB for incorporation with the zeolite base. Moreover, a hydroisomerization catalyst can be used as hydrocracking catalyst in the hydrocracking reactor, i.e. a jet fuel optimization reactor 100 but run at the high end of the hydroisomerization temperature range.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms. It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8 and 12 Angstroms, wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,100,006.

Mixed polyvalent metal-hydrogen zeolites may be prepared by ion-exchanging with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 wt %, and preferably at least about 20 wt %, metal-cation-deficient, based on the initial ion-exchange capacity. In another aspect, a desirable and stable class of zeolites is one wherein at least about 20 wt % of the ion exchange capacity is satisfied by hydrogen ions.

The active metals employed in the preferred hydrocracking catalysts of the present disclosure as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 wt % and about 30 wt % may be used. In the case of the noble metals, it is normally preferred to use about 0.05 to about 2 wt % noble metal. Noble metals may be preferred as the hydrogenation metal on the hydrocracking catalyst to provide selectivity to jet fuel due to the absence of hydrogen sulfide and ammonia which can deactivate noble metal catalysts, but which have been removed upstream in the process.

The method for incorporating the hydrogenation metal is to contact the base material with an aqueous solution of a suitable compound of the desired metal wherein the metal is present in a cationic form. Following addition of the selected hydrogenation metal or metals, the resulting catalyst powder is then filtered, dried, pelleted with added lubricants, binders or the like if desired, and calcined in air at temperatures of, e.g., about 371° C. (700° F.) to about 648° C. (200° F.) in order to activate the catalyst and decompose ammonium ions. Alternatively, the base component may be pelleted, followed by the addition of the hydrogenation component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt %. These diluents may be employed as such, or they may contain a minor proportion of an added hydrogenating metal such as a Group VIB and/or Group VIII metal. Additional metal promoted hydrocracking catalysts may also be utilized in the process of the present disclosure which comprises, for example, aluminophosphate molecular sieves, crystalline chromosilicates and other crystalline silicates. Crystalline chromosilicates are more fully described in U.S. Pat. No. 4,363,178.

By one approach, the hydrocracking conditions may include a temperature from about 290° C. (550° F.) to about 468° C. (875° F.), preferably 371° C. (700° F.) to about 427° C. (800° F.), a pressure from about 3.1 MPa (gauge) (450 psig) to about 4.5 MPa (gauge) (650 psig), a liquid hourly space velocity (LHSV) from about 0.4 to less than about 2.5 hr-1 and a hydrogen rate of about 337 Nm3/m3 (2,000 scf/bbl) to about 2,527 Nm3/m3 oil (15,000 scf/bbl). The hydrocracking pressure may float with the hydrogenation pressure.

Hydroisomerization, including hydrodewaxing, of the heated combined saturated heavy oligomerized olefin stream in the heated hydrocracking charge line 96 is also accomplished over one or more beds of hydroisomerization catalyst, either separately loaded in beds within the jet fuel optimization reactor 100 or as stripes within the hydrocracking catalyst bed in the hydrocracking reactor, i.e. a jet fuel optimization reactor 100. In the embodiment of FIG. 2, hydroisomerization occur simultaneously with the hydrocracking occurring in the jet fuel optimization reactor 100. In a preferred embodiment, the hydrocracking catalyst is contacted with feed before the hydroisomerization catalyst. In a downflow configuration of the hydrocracking reactor, i.e. a jet fuel optimization reactor 100, the hydrocracking catalyst may be loaded on top of the reactor and the hydroisomerization catalyst on the bottom of the reactor. With catalysts that perform predominately cracking and/or predominately isomerization, the same logic may be used.

The hydroisomerization catalyst may comprise a dehydrogenation metal, a molecular sieve and a metal oxide binder. The hydroisomerization catalyst may comprise a dehydrogenation metal comprising a Group VIII metal. The dehydrogenation metal(s) may be selected from platinum, palladium, nickel, nickel molybdenum sulfide or nickel tungsten sulfide. Preferably, the dehydrogenation metal is selected from platinum or nickel tungsten sulfide. The concentration of dehydrogenation metal on the hydroisomerization catalyst may comprise from 0.05 to 5 wt % based on the transition metal(s).

The dehydrogenation metal is distributed between the molecular sieve and the binder with about 40 to about 65 wt %, preferably 45 to about 60 wt %, of the metals distributed on the molecular sieve and about 40 to about 65 wt %, preferably 45 to about 60 wt %, of the metals distributed on the binder. The associated benefit of the hydroisomerization catalyst is high activity and selectivity toward hydroisomerization. In a further embodiment the hydroisomerization catalyst further comprises less than about 0.5 wt % carbon with the associated benefit of high activity and selectivity towards hydroisomerization.

In an embodiment, the hydroisomerization catalyst comprises one or more molecular sieves having a topology selected from AEI, AEL, AFO, AFX, ATO, BEA, CHA, FAU, FER, MEL, MFI, MOR, MRE, MTT, MWW or TON, such as EU-2, ZSM-11, ZSM-22, ZSM-23, ZSM-48, SAPO-5, SAPO-11, SAPO-31, SAPO-34, SAPO-41, SSZ-13, SSZ-16, SSZ-39, MCM-22, zeolite Y, ferrierite, mordenite, ZSM-5 or zeolite beta, with the associated benefit of the molecular sieve being active in the hydroisomerization of linear hydrocarbons.

The metal oxide binder may be taken from the group comprising alumina, silica, silica-alumina and titania or mixtures thereof. Preferably the metal oxide binder is alumina and preferably it is gamma alumina.

The hydroisomerization catalyst typically comprises particles having a diameter of about 1 to about 5 millimeters. The catalyst production typically involves the formation of a stable, porous support, followed by impregnation of active metals. The stable, porous support typically comprises a metal oxide as well as a molecular sieve, which may be a zeolite. The stable support is produced with a high porosity, to ensure maximum surface area, and it is typically desired to disperse the active metal over the full internal and external surface area of the support. DI-100 and/or DI-200 available from UOP LLC in Des Plaines, Illinois may be a suitable hydroisomerization catalyst.

The hydrocracking catalyst and the hydroisomerization catalyst may both be loaded in the hydrocracking reactor, i.e., a jet fuel optimization reactor 100 either intermingled together or in separate beds. Alternatively, just hydroisomerization catalyst that has some hydrocracking function may be loaded in the hydrocracking reactor 100. DI-100 may be a hydroisomerization catalyst capable of performing hydrocracking function. Under hydrocracking conditions, the above-described hydroisomerization catalyst will subject the heated combined saturated heavy oligomerized olefin stream in the hydrocracking charge line 96 to a minority of the hydrocracking function and a majority of the hydroisomerization function. The hydrocracking catalyst within the one or more catalyst beds may range from greater than about 5 wt % to less than about 20 wt %. The hydroisomerization catalyst within the one or more catalyst beds may range from greater than about 80 wt % to less than about 95 wt %.

The cracked stream which may have also undergone hydroisomerization and also be a hydroisomerized stream may exit the hydrocracking reactor, i.e. a jet fuel optimization reactor 100 in a cracked line 92. The cracked stream in line 92 is cooled by heat exchange with the saturated heavy oligomerized stream in line 60 and fed to a hot separator 62. In the hot separator 62, the cracked stream is separated into a vaporous cracked oligomerized stream in a hot separator overhead line 64 extending from a top of the hot separator and a liquid cracked oligomerized stream in the hot separator bottoms line 66 extending from the bottom of the hot separator. The hot separator 62 may operate at a temperature of about 150° C. to about 300° C. and about the same pressure as the jet fuel optimization reactor 100.

The liquid cracked oligomerized stream in line 66 may be heated by heat exchange with the paraffin stream in the diluent line 14. The cooled liquid cracked oligomerized stream in line 66 may be fed with a cold liquid cracked oligomerized stream in a cold bottoms line 114 to a stripping column 70 to be stripped of light gases in a stripping feed line 120. The cold liquid cracked oligomerized stream in the cold bottoms line 114 may be combined with the cooled liquid cracked oligomerized stream in line 66 to provide a combined liquid cracked oligomerized stream in a stripping feed line 120. The vaporous cracked oligomerized stream may be cooled and fed to a cold separator 110. In the cold separator 110, the vaporous cracked oligomerized stream is separated into a cold vaporous cracked oligomerized stream in a cold separator overhead line 112 extending from a top of the cold separator 110 and a cold liquid cracked oligomerized stream in a cold bottoms line 114 extending from the bottom of the cold separator. The cold separator may operate at a temperature of about 40° C. to about 120° C. and a pressure of about 2000 kPa and about 8000 kPa. In an aspect, the cold separator may operate at a pressure of about the same as the hot separator 62.

A preliminary hydrogen stream in line 84 provides hydrogen to a make-up compressor 86 to provide a make-up hydrogen stream in line 68. A purge stream in line 65 which is normally no flow may be taken from the cold vaporous cracked oligomerized stream in line 112 and a remaining recycle stream in a recycle line 115 may be compressed in a recycle compressor 118 and combined with make-up hydrogen in line 68 downstream of the make-up compressor 86 to provide the hydrogen stream in line 116. The cold liquid cracked oligomerized stream in the cold bottoms line 114 may be combined with the liquid cracked oligomerized stream in line 66 to provide a combined liquid cracked oligomerized stream in a stripping feed line 120 and be fed to the stripping column 70 to be stripped of light gases.

The combined liquid cracked oligomerized stream in the stripping feed line 66 may be fed to the stripping column 70 to be stripped of light gases and separated into product streams. A downstream fractionation column may not be necessary to provide a jet fuel product stream after stripping. In the stripping column 70, the combined liquid cracked oligomerized stream may be separated into an off-gas stream in an overhead line 72, a green jet stream in a side line 74 from a side of the stripping column 70 and a heavy drag stream in a bottoms line 76. The stripping column 70 may be operated at a bottoms temperature of about 250° C. (482° F.) to about 500° C. (932° F.) and an overhead pressure of about 20.7 kPa (3 psia) to about 350 kPa (50 psia). The overhead pressure may be from about 35 kPa (5 psiA) to about 207 kPa (30 psiA). The bottoms temperature may be from about 250° C. (482° F.) to about 427° C. (800° F.) or from about 400° C. (800° F.) to about 482° C. (900° F.).

The stripping overhead stream in the overhead line 72 may be cooled and a resulting condensate portion refluxed from a stripping receiver 78 back to the stripping column 70 in line 79 while a net off gas stream comprising hydrogen and C7-hydrocarbon cracked products is taken in a receiver overhead line 80 from the stripping receiver 78. Most of the hydrocarbons in the net off gas stream in the receiver overhead line 80 are lighter hydrocarbons and can be used to fuel the reboiler for the stripping column 70 and/or the olefin splitter column 36 or routed to hydrogen recovery or to a fuel gas header.

The green jet stream taken in the side line 74 from a bottom half of the stripping column 70 comprises kerosene range C8-C17 hydrocarbons. The green jet stream in the side line 74 may be split into a first stream in a jet product line 75 which may be cooled and taken as a jet product stream meeting applicable SPK standards including an ASTM D86 end point of no more than 300° C. (572° F.). The jet fuel product stream in the jet product line 75 can be fed to the jet fuel pool. The green jet stream in the side line 74 may also be split into a second stream comprising the diluent stream in line 14. The diluent stream in line 14 may be pumped and cooled by heat exchange with the liquid cracked oligomerization stream in the hot separator bottoms line 66. The cooled diluent stream in line 14 may be recycled back to be mixed with the olefin stream in line 12 in the oligomerization section 10 in FIG. 1, preferably the first olefin stream in line 12*a*, to provide the first diluted olefin stream in line 16*a* to absorb the exotherm in the first-stage oligomerization reactor 22. Alternatively, some or all of the cooled diluent stream in line 14 may be recycled back to be mixed with the second stage oligomerization charge stream in line 28. The green jet fuel in the diluent line 14 is paraffinic, so it will be inert to the dimerization, oligomerization and hydrogenation reactions to which it may be subject. It is also contemplated that the liquid cracked oligomerized stream in the hot separator bottoms line 66 may be taken as the diluent stream in line 14.

In an alternative embodiment, a green jet stream may be taken from the condensate stream in line 79 from the stripping receiver 78 instead of refluxing all of the condensate to the stripping column 70. This green jet stream taken from line 79 may have to be stripped to remove light ends. In such an embodiment, no side line 74 would be taken to recover the green jet fuel stream because it is recovered from the condensate stream in line 79.

A diesel stream is taken in the bottoms line 76 and split between a reboil stream that is reboiled and fed back to the stripping column 70 in line 77, and a small heavy drag stream in a net stripping bottoms line 82 comprising a green diesel product stream to achieve jet cut specifications for the green jet stream. The green diesel product stream in line 82 may be less than 10 wt %, suitably less than about 5 wt % and preferably less than 1 wt % of the combined liquid cracked oligomerized stream in line 120. The diesel stream will meet ASTM D975 standards for diesel and may be blended with the diesel pool.

Turning to the oligomerization section 10 of FIG. 1, a charge olefin stream in line 12 is provided to the oligomerization section 10. The charge olefin stream may comprise substantial ethylene. The charge olefin stream may predominantly comprise ethylene. In an aspect, the charge olefin stream may comprise at least 95 mol % ethylene. The charge olefin stream in line 12 may be styled an ethylene stream. The olefin stream may be provided by the dehydration of ethanol or provided from a MTO unit. The charge olefin stream may be at a temperature of about 60° C. (140° F.) to about 150° C. (302° F.), preferably about 80° C. (176° F.) to about 100° C. (212° F.) and a pressure of about 3.5 MPag (500 psig), preferably about 5.6 MPag (800 psig) to about 8.4 MPag (1200 psig).

The charge olefin stream may be initially contacted with a first-stage oligomerization catalyst to dimerize the ethylene to dimers and oligomerize the dimers to oligomers and then contacted with a second oligomerization catalyst to dimerize unconverted ethylene and oligomerize dimerized and oligomerized ethylene from the first-stage oligomerization. Alternatively, the olefin stream may be initially contacted with a second stage oligomerization catalyst to dimerize ethylene, and then be contacted with the first-stage oligomerization catalyst to oligomerize the dimerized ethylene.

The dimerization reaction generates a large exotherm. For example, dimerization of ethylene can generate 612 kcal/kg (1100 BTU/lb) of heat. Consequently, this large exotherm must be managed.

Accordingly, the charge olefin stream in line 12 may be split into multiple olefin streams. In FIG. 1, the olefin stream is split into four separate streams: a first olefin stream in charge line 12*a*, a second olefin stream in charge line 12*b*, a third olefin stream in charge line 12*c* and a fourth or last olefin stream in charge line 12*d*. More or less separate multiple olefin streams may be used. Up to six olefin streams are readily contemplated. The charge olefin stream in line 12 may be split into equal aliquot multiple olefin streams. Alternatively, the charge olefin stream in line 12 may be split into unequal streams. For example, the charge olefin stream may be split into streams of ascending flow rates in which an olefin stream to a subsequent reactor has a larger flow rate than an olefin stream to a preceding reactor. In an embodiment, the charge olefin stream is split into four streams of equal flow rates, each comprising 25 vol % of the charge olefin stream. In another embodiment, the charge olefin stream is divided into two olefin streams, a first olefin stream in charge line 12*a* and a second olefin stream in charge line 12*b*. The first olefin stream may comprise about 70 to about 90 vol % of the charge olefin stream and the second olefin stream may comprise about 10 to about 30 vol % of the charge olefin stream.

To manage the exotherm, the olefin stream may be diluted with a diluent stream to provide a diluted olefin stream to absorb the exotherm. The diluent stream may comprise a paraffin stream in a diluent line 14. The diluent stream in the diluent line 14 may be added to the charge olefin stream in line 12 before the charge olefin stream is split into multiple olefin streams. Preferably, the diluent stream is added to the first olefin stream in line 12*a* after the split into multiple olefin streams to provide a first diluted olefin stream in line 16*a*, so the diluent stream passes through all of all of the first-stage oligomerization reactions. Alternatively, the diluent stream may also be split into multiple streams with each diluent stream added to a corresponding olefin stream. The diluent stream may have a volumetric flow rate of about 2 to about 8 times and preferably about 3 to about 6 times the volumetric flow rate of the charge olefin stream. The first diluted olefin stream may comprise no more than 35 wt % olefins, suitably no more than 30 wt % olefins and preferably no more than 20 wt % olefins. In an embodiment, the first diluted olefin stream comprises about 10 to about 30 wt % C2 to C8 olefins. The first diluted olefin stream may comprise no more than 30 wt % ethylene, suitably no more than 25 wt % ethylene and preferably no more than 20 wt % ethylene. In an embodiment, the first diluted olefin stream comprises about 10 to about 20 wt % ethylene. The first diluted olefin stream in line 16*a* may be cooled in a first charge cooler 18*a* to provide a first cooled diluted olefin stream in line 20*a*, mixed with an oligomer recycle stream in an oligomer recycle line 26 to provide a first-stage oligomerization charge stream in a first-stage oligomer charge line 21*a* and charged to a first bed 22*a* of first-stage oligomerization catalyst in a first-stage oligomerization reactor 22. The first-stage oligomerization charge stream in line 21*a* may be charged at a temperature of about 180° C. (356° F.) to about 260° C. (500° F.) and a pressure of about 3.5 MPag (500 psig) to about 8.4 MPag (1200 psig). The charge cooler 18*a* may comprise a steam generator.

The first-stage oligomerization reactor 22 may comprise a series of first-stage oligomerization catalyst beds 22*a*, 22*b*, 22*c* and 22*d* for charging with each multiple olefin stream 12*a*, 12*b*, 12*c*, and 12*d*, respectively. The first-stage oligomerization reactor preferably contains four fixed first-stage oligomerization catalyst beds 22*a*, 22*b*, 22*c* and 22*d*. It is also contemplated that each first-stage oligomerization catalyst bed 22*a*, 22*b*, 22*c* and 22*d* may be in a dedicated first-stage oligomerization reactor or multiple first-stage oligomerization catalyst beds may be in two or more separate first-stage oligomerization reactors. Up to six, first-stage oligomerization catalyst beds are readily contemplated. A parallel first-stage oligomerization reactor may be used when the first-stage oligomerization reactor 22 has deactivated during which the first-stage oligomerization reactor 22 is regenerated in situ by combustion of coke from the catalyst. In another embodiment, each first-stage oligomerization reactor may comprise a lead reactor, a lag reactor and a spare reactor to facilitate regeneration.

The first-stage oligomerization charge stream may be charged to the first, first-stage catalyst bed 22*a* in line 21*a*, preferably in a down flow operation. However, upflow operation may be suitable. As dimerization of ethylene occurs in the first, first-stage oligomerization catalyst bed 22*a*, an exotherm is generated due to the exothermic nature of the ethylene dimerization reaction. Dimerization and oligomerization of the first-stage oligomerization charge stream comprising the first olefin stream produces a first oligomerized olefin stream in a first oligomerized effluent line 24*a* at an elevated outlet temperature despite the cooling and dilution. The elevated outlet temperature is limited to between 150° C. (302° F.) and about 250° C. (482° F.).

The second olefin stream in line 12*b* may be diluted with the first oligomerized olefin stream in line 24*a* removed from the first, first-stage oligomerization reactor 22 to provide a second diluted olefin stream in line 16*b*. The first oligomerized olefin stream in line 24*a* includes the diluent stream from diluent line 14 added to the first olefin stream in line 12*a*. The second diluted olefin stream may comprise no more than 35 wt % C2 to C8 olefins, suitably no more than 25 wt % C2 to C8 olefins and preferably no more than 20 wt % ethylene. The second diluted olefin stream may comprise no more than 30 wt % ethylene, suitably no more than 25 wt % ethylene and preferably no more than 20 wt % ethylene. The second diluted olefin stream in line 16*b* may be cooled in a second charge cooler 18*b* which may be located externally to the dimerization reactor 22 to provide a second cooled diluted olefin stream in line 20*b* and charged to a second bed 22*b* of first-stage oligomerization catalyst in a first-stage oligomerization reactor 22. The charge cooler 18*b* may comprise a steam generator.

The second diluted olefin stream in line 20*b* may be charged at a temperature of about 180° C. (356° F.) to about 230° C. (446° F.) and a pressure of about 3.5 MPag (500 psig) to about 8.4 MPag (1200 psig). The second diluted olefin stream will include diluent and olefins from the first oligomerized olefin stream. The olefins from the first oligomerized olefin stream will dimerize and oligomerize in the second catalyst bed 22*b*. Dimerization and oligomerization of ethylene and oligomers in the second olefin stream in the second bed 22*b* of first-stage oligomerization catalyst produces a second oligomerized olefin stream in a second dimerized effluent line 24*b* at an elevated outlet temperature. The elevated outlet temperature may be limited to between 30° C. (54° F.) and about 50° C. (90° F.) above the inlet temperature to the catalyst bed 22*b*.

The third olefin stream in line 12*c* may be diluted with the second oligomerized olefin stream in line 24*b* removed from the second, first-stage oligomerization reactor 22 to provide a third diluted olefin stream in line 16*c*. Alternatively, the third olefin stream in line 12*c* has no flow and line 16*c* only transports the second oligomerized olefins stream from line 24*b*. The second oligomerized olefin stream in line 24*b* includes the diluent stream from diluent line 14 added to the first olefin stream in line 12*a*. The third diluted olefin stream may comprise no more than 30 wt % ethylene, suitably no more than 25 wt % ethylene and preferably no more than 20 wt % ethylene. The third diluted olefin stream may comprise no more than 30 wt % C2 to C8 olefins, suitably no more than 25 wt % C2 to C8 olefins and preferably no more than 20 wt % C2 to C8 olefins. The third diluted olefin stream in line 16*c* may be cooled in a third charge cooler 18*c* which may be located externally to the dimerization reactor 22 to provide a third cooled diluted olefin stream in line 20*c* and charged to a third bed 22*c* of first-stage oligomerization catalyst in the first-stage oligomerization reactor 22. The charge cooler 18*c* may comprise a steam generator.

The third cooled diluted olefin stream in line 20*c* may be charged at a temperature of about 180° C. (356° F.) to about 230° C. (446° F.) and a pressure of about 3.5 MPag (500 psig) to about 8.4 MPag (1200 psig). The third diluted olefin stream will include diluent and olefins from the second oligomerized olefin stream. The olefins from the second oligomerized stream will oligomerize in the third catalyst bed 22*c*. Dimerization of ethylene and oligomerization of oligomers in the third olefin stream in the third bed 22*c* of first-stage oligomerization catalyst produces a third oligomerized olefin stream in a third oligomerized effluent line 24*c* at an elevated outlet temperature. In an embodiment, the third oligomerized olefin stream is a penultimate oligomerized olefin stream and the third oligomerized effluent line 24*c* is a penultimate oligomerized effluent line 24*c*. The elevated outlet temperature is limited to between 30° C. (54° F.) and about 50° C. (90° F.) above the inlet temperature to the catalyst bed 22*c*.

The fourth olefin stream in line 12*d* may be diluted with the third or penultimate oligomerized olefin stream in line 24*c* removed from the first-stage oligomerization reactor 22 to provide a fourth diluted olefin stream in line 16*d*. The third or penultimate oligomerized olefin stream in line 24*c* includes the diluent stream from diluent line 14 added to the first olefin stream in line 12*a*. The fourth olefin stream in line 12*d* may be a no flow, and line 16*d* only transports the third oligomerized olefins stream from line 24*c*. The fourth diluted olefin stream may comprise no more than 35 wt % C2 to C8 olefins, suitably no more than 30 wt % C2 to C8 olefins and preferably no more than 25 wt % C2 to C8 olefins. The fourth diluted olefin stream may comprise no more than 30 wt % ethylene, suitably no more than 25 wt % ethylene and preferably no more than 20 wt % ethylene. The fourth diluted olefin stream in line 16*d* may be cooled in a fourth charge cooler 18*d* which may be located externally to the dimerization reactor 22 to provide a fourth cooled diluted olefin stream in line 20*d* and charged to a fourth bed 22*d* of first-stage oligomerization catalyst in the first-stage oligomerization reactor 22. The charge cooler 18*d* may comprise a steam generator.

The fourth cooled diluted olefin stream in line 20*d* may be charged at a temperature of about 180° C. (356° F.) to about 230° C. (446° F.) and a pressure of about 3.5 MPag (500 psig) to about 8.4 MPag (1200 psig). The fourth or last diluted olefin stream will include diluent and olefins from the third or penultimate oligomerized olefin stream. The olefins from the third or penultimate oligomerized olefin stream will dimerize and oligomerize in the fourth catalyst bed 22*d*. Dimerization of ethylene and oligomerization of olefins in the fourth olefin stream in the fourth bed 22*d* of first-stage oligomerization catalyst produces a fourth oligomerized olefin stream in a fourth oligomerized effluent line 24*d* at an elevated outlet temperature. The elevated outlet temperature is limited to between 30° C. (54° F.) and about 50° C. (90° F.) above the inlet temperature to the catalyst bed 22*d*.

In an embodiment, the fourth olefin stream is a last olefin stream, the fourth oligomerized olefin stream is a last oligomerized olefin stream and the fourth oligomerized effluent line 24*d* is a last oligomerized effluent line 24*d*.

The first-stage oligomerization reaction takes place predominantly in the liquid phase or in a mixed liquid and gas phase at a LHSV 0.5 to 10 $hr^{-1}$ on an olefin basis. We have found that across the first-stage oligomerization catalyst beds, typically 30-50 wt % ethylene in the olefin stream converts to higher olefins. The ethylene will initially dimerize over the catalyst to butenes. A predominance of the butenes in the olefins stream charged to a first-stage oligomerization catalyst bed is oligomerized. In an embodiment, at least 99 mol % of butenes in the olefins stream are oligomerized.

The first-stage oligomerization catalyst may include a zeolitic catalyst. The first-stage oligomerization catalyst may be considered a solid acid catalyst. The zeolite may comprise between about 5 and about 95 wt % of the catalyst, for example between about 5 and about 85 wt %. Suitable zeolites include zeolites having a structure from one of the following classes: MFJ, MEL, ITH, IMF, TUN, FER, BEA, FAU, BPH, MEI, MSE, MWW, UZM-8, MOR, OFF, MTW, TON, MTT, AFO, ATO, and AEL. 3-letter codes indicating a zeotype are as defined by the Structure Commission of the International Zeolite Association and are maintained at http://www.iza-structure.org/databases. UZM-8 is as described in U.S. Pat. No. 6,756,030. In a preferred aspect, the first-stage oligomerization catalyst may comprise a zeolite with a framework having a ten-ring pore structure. Examples of suitable zeolites having a ten-ring pore structure include TON, MTT, MFJ, MEL, AFO, AEL, EUO and FER. In a further preferred aspect, the first-stage oligomerization catalyst comprising a zeolite having a ten-ring pore structure may comprise a uni-dimensional pore structure. A uni-dimensional pore structure indicates zeolites containing non-intersecting pores that are substantially parallel to one of the axes of the crystal. The pores preferably extend through the zeolite crystal. Suitable examples of zeolites having a ten-ring uni-dimensional pore structure may include MTT. In a further aspect, the first-stage oligomerization catalyst comprises an MTT zeolite.

The first-stage oligomerization catalyst may be formed by combining the zeolite with a binder, and then forming the catalyst into pellets. The pellets may optionally be treated with a phosphorus reagent to create a zeolite having a phosphorous component between 0.5 and 15 wt % of the treated catalyst. The binder is used to confer hardness and strength on the catalyst. Binders include alumina, aluminum phosphate, silica, silica-alumina, zirconia, titania and combinations of these metal oxides, and other refractory oxides, and clays such as montmorillonite, kaolin, palygorskite, smectite and attapulgite. A preferred binder is an aluminum-based binder, such as alumina, aluminum phosphate, silica-alumina and clays.

One of the components of the catalyst binder utilized in the present invention is alumina. The alumina source may be any of the various hydrous aluminum oxides or alumina gels such as alpha-alumina monohydrate of the boehmite or pseudo-boehmite structure, alpha-alumina trihydrate of the gibbsite structure, beta-alumina trihydrate of the bayerite structure, and the like. A suitable alumina is available from UOP LLC under the trademark VERSAL. A preferred alumina is available from Sasol North America Alumina Product Group under the trademark Catapal. This material is an extremely high purity alpha-alumina monohydrate (pseudo-boehmite) which after calcination at a high temperature has been shown to yield a high purity gamma-alumina.

A suitable first-stage oligomerization catalyst is prepared by mixing proportionate volumes of zeolite and alumina to achieve the desired zeolite-to-alumina ratio. In an embodiment, the MTT content may about 5 to 85, for example about 20 to 82 wt % MTT zeolite, and the balance alumina powder will provide a suitably supported catalyst. A silica support is also contemplated.

Monoprotic acid such as nitric acid or formic acid may be added to the mixture in aqueous solution to peptize the alumina in the binder. Additional water may be added to the mixture to provide sufficient wetness to constitute a dough with sufficient consistency to be extruded or spray dried. Extrusion aids such as cellulose ether powders can also be added. A preferred extrusion aid is available from The Dow Chemical Company under the trademark Methocel.

The paste or dough may be prepared in the form of shaped particulates, with the preferred method being to extrude the dough through a die having openings therein of desired size and shape, after which the extruded matter is broken into extrudates of desired length and dried. A further step of calcination may be employed to give added strength to the extrudate. Generally, calcination is conducted in a stream of air at a temperature from about 260° C. (500° F.) to about 815° C. (1500° F.). The MTT catalyst is not selectivated to neutralize acid sites such as with an amine.

The extruded particles may have any suitable cross-sectional shape, i.e., symmetrical or asymmetrical, but most often have a symmetrical cross-sectional shape, preferably a spherical, cylindrical or polylobal shape. The cross-sectional diameter of the particles may be as small as 40 μm; however, it is usually about 0.635 mm (0.25 inch) to about 12.7 mm (0.5 inch), preferably about 0.79 mm (1/32 inch) to about 6.35 mm (0.25 inch), and most preferably about 0.06 mm (1/24 inch) to about 4.23 mm (1/6 inch).

In one exemplary embodiment, an MTT-type zeolite catalyst disposed on a high purity pseudo boehmite alumina substrate in a ratio of about 90/10 to about 20/80 and preferably between about 20/80 and about 50/50 is provided in a catalyst bed or more in the first-stage oligomerization reactor 22.

The first-stage oligomerization catalyst can be regenerated upon deactivation. Suitable regeneration conditions include subjecting the first-stage oligomerization catalyst, for example, in situ, to hot air at about 400 to about 500° C. for 3 hours. To facilitate regeneration without downtime, a swing bed arrangement may be employed with an alternative first-stage oligomerization reactor. A regeneration gas stream may be admitted to the first-stage oligomerization reactor 22 requiring regeneration. The regeneration gas may comprise air with an increased or decreased concentration of oxygen. Activity and selectivity of the regenerated catalyst is comparable to fresh catalyst.

The zeolite catalyst is advantageous as a first-stage oligomerization catalyst. The zeolitic catalyst has relatively low sensitivity towards oxygenates contamination. Consequently, a smaller degree of removal of oxygenates is required of olefinic feed in line 12 if produced from an ethanol dehydration process.

The last first-stage oligomerized olefin stream in the last first-stage oligomerized effluent line 24*d* has an increased concentration of ethylene dimers and oligomers compared to the charge olefin stream in line 12. The last first-stage oligomerized olefin stream in the last first-stage oligomerized effluent line 24*d* is cooled by steam generation or by other heat exchange to provide a charge second-stage oligomerization stream and charged to a second-stage oligomerization reactor 32 in a second-stage oligomerization charge line 28. To achieve the most desirable olefin product, the second-stage oligomerization reactor 32 is operated at a temperature from about 80° C. (176° F.) to about 180° C. (356° F.). The second-stage oligomerization reactor 32 is run at a pressure from about 2.1 MPa (300 psig) to about 7.6 MPa (1100 psig), and more preferably from about 3.5 MPa (500 psig) to about 6.9 MPa (1000 psig).

The second-stage oligomerization reactor 32 may be in downstream communication with the first-stage oligomerization reactor 22. The second-stage oligomerization reactor 32 preferably operates in a down flow operation. However, upflow operation may be suitable. The second-stage oligomerization charge stream is contacted with the second-stage oligomerization catalyst causing the unconverted ethylene form the first-stage oligomerization reactor 22 to dimerize and trimerize while higher olefins also dimerize, trimerize and tetramerize to provide distillate range olefins. With regard to the second-stage oligomerization reactor 32, process conditions are selected to produce a higher percentage of jet range olefins which, when hydrogenated in a subsequent step as will be described below, result in a desirable jet-range hydrocarbon product. A predominance of the unconverted ethylene from the first-stage oligomerization reactor 22 is dimerized, trimerized and tetramerized. In an embodiment, at least 99 wt % of ethylene in the second-stage oligomerization charge stream is converted to mostly butenes. A second-stage oligomerized olefin stream with an increased average carbon number greater than the second-stage oligomerization charge stream in line 28 exits the second-stage oligomerization reactor 32 in line 34. Alternatively, the oligomer recycle stream in line 26 is mixed with the charge olefin stream in line 12 and the diluent stream in line 14 and is charged to the first-stage oligomerization reactor 22.

The second-stage oligomerization catalyst is preferably an amorphous silica-alumina base with a metal from either Group VIII and/or Group VIB in the periodic table using Chemical Abstracts Service notations. In an aspect, the catalyst has a Group VIII metal promoted with a Group VIB metal. Typically, the silica and alumina will only be in the base, so the silica-to-alumina ratio will be the same for the catalyst as for the base. The metals can either be impregnated onto or ion exchanged with the silica-alumina base. Co-mulling is also contemplated. Catalysts for the present invention may have a Low Temperature Acidity Ratio of at least about 0.15, suitably of about 0.2, and preferably greater than about 0.25, as determined by Ammonia Temperature Programmed Desorption (Ammonia TPD) as described hereinafter. Additionally, a suitable catalyst will have a surface area of between about 50 and about 400 $m^2/g$ as determined by nitrogen BET.

The preferred second-stage oligomerization catalyst comprises an amorphous silica-alumina support. One of the components of the catalyst support utilized in the present invention is alumina. The alumina may be any of the various hydrous aluminum oxides or alumina gels such as alpha-alumina monohydrate of the boehmite or pseudo-boehmite structure, alpha-alumina trihydrate of the gibbsite structure, beta-alumina trihydrate of the bayerite structure, and the like. A particularly preferred alumina is available from Sasol North America Alumina Product Group under the trademark Catapal. This material is an extremely high purity alpha-alumina monohydrate (pseudo-boehmite) which after calcination at a high temperature has been shown to yield a high purity gamma-alumina. Another component of the catalyst support is an amorphous silica-alumina. A suitable silica-alumina with a silica-to-alumina ratio of 2.6 is available from CCIC, a subsidiary of JGC, Japan.

Another component utilized in the preparation of the second-stage oligomerization catalyst utilized in the present invention is a surfactant. The surfactant is preferably admixed with the hereinabove described alumina and the silica-alumina powders. The resulting admixture of surfactant, alumina and silica-alumina is then formed, dried and calcined as hereinafter described. The calcination effectively removes by combustion the organic components of the surfactant but only after the surfactant has dutifully performed its function in accordance with the present invention. Any suitable surfactant may be utilized in accordance with the present invention. A preferred surfactant is a surfactant selected from a series of commercial surfactants sold under the trademark "Antarox" by Solvay S.A. The "Antarox" surfactants are generally characterized as modified linear aliphatic polyethers and are low-foaming biodegradable detergents and wetting agents.

A suitable silica-alumina mixture is prepared by mixing proportionate volumes silica-alumina and alumina to achieve the desired silica-to-alumina ratio. In an embodiment, about 75 to about 99 wt-% amorphous silica-alumina with a silica-to-alumina ratio of 2.6 and about 10 to about 20 wt-% alumina powder will provide a suitable support. In an embodiment, other ratios of amorphous silica-alumina to alumina may be suitable.

Any convenient method may be used to incorporate a surfactant with the silica-alumina and alumina mixture. The surfactant is preferably admixed during the admixture and formation of the alumina and silica-alumina. A preferred method is to admix an aqueous solution of the surfactant with the blend of alumina and silica-alumina before the final formation of the support. It is preferred that the surfactant be present in the paste or dough in an amount from about 0.01 to about 10 wt-% based on the weight of the alumina and silica-alumina.

Monoprotic acid such as nitric acid or formic acid may be added to the mixture in aqueous solution to peptize the alumina in the binder. Additional water may be added to the mixture to provide sufficient wetness to constitute a dough with sufficient consistency to be extruded or spray dried.

The paste or dough may be prepared in the form of shaped particulates, with the preferred method being to extrude the dough mixture of alumina, silica-alumina, surfactant and water through a die having openings therein of desired size and shape, after which the extruded matter is broken into extrudates of desired length and dried. A further step of calcination may be employed to give added strength to the extrudate. Generally, calcination is conducted in a stream of dry air at a temperature from about 260° C. (500° F.) to about 815° C. (1500° F.).

The extruded particles may have any suitable cross-sectional shape, i.e., symmetrical or asymmetrical, but most often have a symmetrical cross-sectional shape, preferably a spherical, cylindrical or polylobal shape. The cross-sectional diameter of the particles may be as small as 40 km; however, it is usually about 0.635 mm (0.25 inch) to about 12.7 mm (0.5 inch), preferably about 0.79 mm (1/32 inch) to about 6.35 mm (0.25 inch), and most preferably about 0.06 mm (1/24 inch) to about 4.23 mm (1/6 inch).

Typical characteristics of the amorphous silica-alumina supports utilized herein are a total pore volume, average pore diameter and surface area large enough to provide substantial space and area to deposit the active metal components. The total pore volume of the support, as measured by conventional mercury porosimeter methods, is usually about 0.2 to about 2.0 cc/gram, preferably about 0.25 to about 1.0 cc/gram and most preferably about 0.3 to about 0.9 cc/gram. Ordinarily, the amount of pore volume of the support in pores of diameter greater than 100 angstroms is less than about 0.1 cc/gram, preferably less than 0.08 cc/gram, and most preferably less than about 0.05 cc/gram. Surface area, as measured by the B.E.T. method, is typically above 50 $m^2$/gram, e.g., above about 200 $m^2$/gram, preferably at least 250 $m^2$/gram., and most preferably about 300 $m^2$/gram to about 400 $m^2$/gram.

To prepare the second-stage oligomerization catalyst, the support material is compounded, as by a single impregnation or multiple impregnations of a calcined amorphous refractory oxide support particles, with one or more precursors of at least one metal component from Group VIII or VIB of the periodic table. The Group VIII metal, preferably nickel, should be present in a concentration of about 0.5 to about 15 wt-% and the Group VIB metal, preferably tungsten, should be present in a concentration of about 0 to about 12 wt-%. The impregnation may be accomplished by any method known in the art, as for example, by spray impregnation wherein a solution containing the metal precursors in dissolved form is sprayed onto the support particles. Another method is the multi-dip procedure wherein the support material is repeatedly contacted with the impregnating solution with or without intermittent drying. Yet other methods involve soaking the support in a large volume of the impregnation solution or circulating the support therein, and yet one more method is the pore volume or pore saturation technique wherein support particles are introduced into an impregnation solution of volume just sufficient to fill the pores of the support. On occasion, the pore saturation technique may be modified, so as to utilize an impregnation solution having a volume between 10 percent less and 10 percent more than that which will just fill the pores.

If the active metal precursors are incorporated by impregnation, a subsequent or second calcination at elevated temperatures, as for example, between 399° C. (750° F.) and 760° C. (1400° F.), converts the metals to their respective oxide forms. In some cases, calcinations may follow each impregnation of individual active metals. A subsequent calcination yields a catalyst containing the active metals in their respective oxide forms.

A preferred second-stage oligomerization catalyst of the present invention has an amorphous silica-alumina base impregnated with 0.5-15 wt-% nickel in the form of 3.175 mm (0.125 inch) extrudates and a density of about 0.45 to about 0.65 g/ml. It is also contemplated that metals can be incorporated onto the support by other methods such as ion-exchange and co-mulling.

The second-stage oligomerization catalyst can be regenerated upon deactivation. Suitable regeneration conditions include subjecting the catalyst, for example, in situ, to hot air at about 400 to about 500° C. for 3 hours. To facilitate regeneration without downtime, a swing bed arrangement may be employed with an alternative second-stage oligomerization reactor. The regeneration gas may comprise air with an increased or decreased concentration of oxygen. Activity and selectivity of the regenerated catalyst is comparable to fresh catalyst.

Oligomerization reactions are also exothermic in nature. The last dimerized olefin stream in line **24*d* includes the diluent stream from diluent line 14 added to the first olefin stream in line 12*a* and carried through the first-stage oligomerization catalyst beds 22*a*-22*d*. The diluent stream is then transported into the second-stage oligomerization reactor 32 in line 28** to absorb the exotherm in the second-stage oligomerization reactor.

When the oligomerization reaction is performed according to the above-noted process conditions, a C4 olefin conversion of greater than or equal to about 95% is achieved, or greater than or equal to 97%. The resulting oligomerized olefin stream in line 34 includes a plurality of olefin products that are distillate range hydrocarbons.

An oligomerized olefin stream in line 34 with an increased C8+ olefin concentration compared to the second-stage oligomerization charge stream in line 28 is heat exchanged with an olefin splitter bottoms stream in line 30 let down in pressure and fed to olefin splitter column 36. The oligomerized olefin stream in line 34 is at a temperature from about 160° C. (320° F.) to about 190° C. (374° F.) and a pressure of about 3.9 MPa (gauge) (550 psig) to about 7 MPa (gauge) (1000 psig).

In the olefin splitter column 36 light oligomerized olefins that boil lower than the jet range hydrocarbons, typically C7-hydrocarbons with atmospheric boiling points less than about 150° C., are separated in an olefin splitter overhead stream in an overhead line 38 from a bottoms stream in a bottoms line 40 comprising heavy oligomerized distillate-range C8+ hydrocarbons, typically C8-C22 olefins. The olefin splitter column 36 may be operated at a bottoms temperature of about 250° C. (482° F.) to about 310° C. (590° F.) and an overhead pressure of about 35 kPa (gauge) (5 psig) to about 175 kPa (gauge) (25 psig). It is envisioned that the olefin splitter column 36 may be two columns.

The olefin splitter overhead stream may be cooled to about 66° C. (150° F.) to about 93° C. (200° F.) and a resulting condensate portion refluxed from an olefin splitter receiver 42 back to the olefin splitter column 36. A net vapor stream in a receiver overhead line 44 from the olefin splitter receiver 42 may be compressed up to oligomerization pressure in an off-gas compressor 46 to provide a light oligomer stream in line 48 either in vapor phase or in liquid phase after cooling. Alternatively, the olefin splitter overhead stream in the overhead line 38 may be fully condensed by cooling perhaps in an external refrigeration loop to provide a liquid light oligomer stream in line 48. The light oligomer stream in line 48 may be split between a light olefin drag stream in line 50 and the oligomer recycle stream in an oligomer recycle line 26 that may be recycled to the first-stage oligomerization reactor 22 or alternatively to the second-stage oligomerization reactor 32. The light olefin drag stream in line 50 may comprise about 1 to about 15 wt % of the light oligomer stream in line 48. The light oligomer stream in line 48 may comprise about 40 to about 80 wt % C4-C8 olefins.

In an embodiment, the recycle oligomer stream in line 26 may be mixed with the first diluted olefin stream in line 16*a* or divided up between the first through fourth diluted olefin streams in lines 16*a*-16*d* or only the penultimate diluted olefin stream in line 16*c* and/or the last diluted olefin stream in line 16*d* to dimerize unreacted ethylene.

The heavy olefin stream in the splitter bottoms line 40 may be split between a reboil stream that is reboiled and fed back to the olefin splitter column 36 and a heavy olefin stream in a net splitter bottoms line 30. The heavy olefin stream in the net bottoms line 30 is cooled by heat exchange with the oligomerized olefin stream in line 34 before it is transported to the hydroprocessing section 80 in FIG. 2.

Starting with ethylene, the disclosed process can efficiently produce green jet fuel that meets applicable fuel requirements while managing exothermic heat generation. Carbon recovery in the process can exceed 95%.

EXAMPLE

Figure 3:
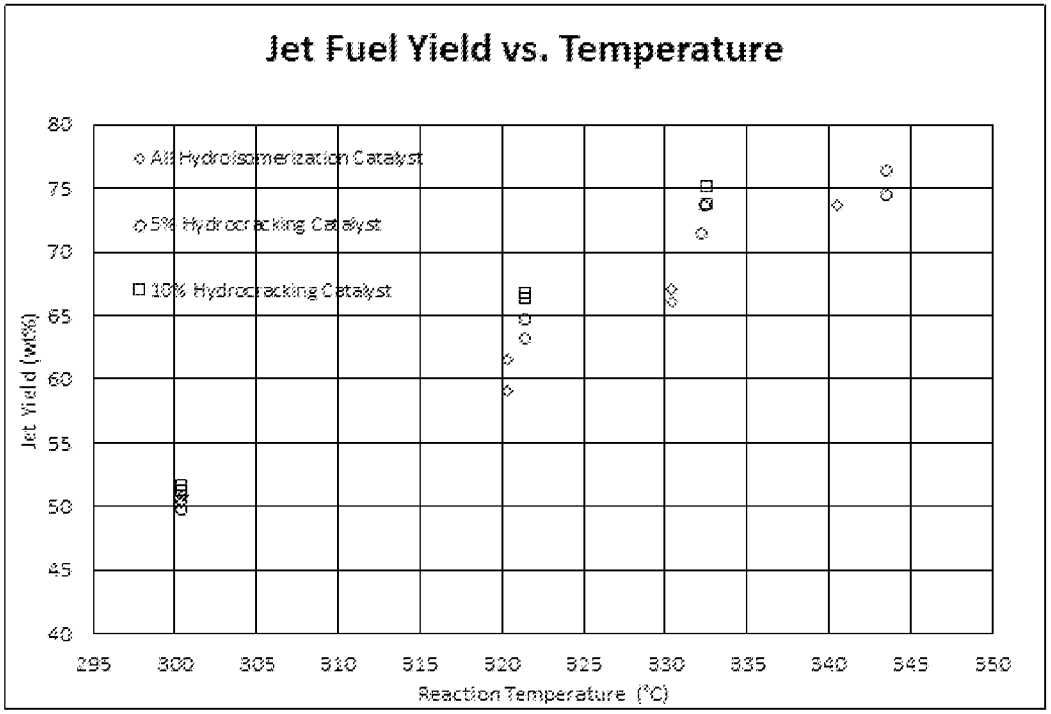
In FIG. 3, jet fuel yield is plotted as a function of average catalyst temperature.

We conducted a pilot plant experiment that subjected oligomerized effluent to hydrotreating and hydrocracking. In Series A, we utilized 100% hydroisomerization catalyst. In series B, we utilized 5 wt % hydrocracking catalyst and in Series C, we employed 10 wt % hydrocracking catalyst with the balance in both cases being hydroisomerization catalyst. The LHSV was about 1, the gas to oil ratio was about 2083-85 on a volumetric basis and the pressure was about 3.5 MPa (g) (500 psig). In FIG. 3, jet fuel yield is plotted as a function of average catalyst temperature. It can be seen that the larger proportion of hydroisomerization catalyst produces higher yields of jet fuel.

SPECIFIC EMBODIMENTS

While the following is described in conjunction with specific embodiments, it will be understood that this description is intended to illustrate and not limit the scope of the preceding description and the appended claims.

A first embodiment of the invention is a process for oligomerizing an olefin stream comprising dimerizing the olefin stream with a first-stage oligomerization catalyst to produce a first-stage oligomerized olefin stream; oligomerizing the first-stage oligomerized olefin stream with a second-stage oligomerization catalyst to provide a second-stage oligomerized stream; feeding the oligomerized stream to a hydrocracking reactor, i.e. a jet fuel optimization reactor comprising two catalysts; and cracking and hydroisomerizing the second-stage oligomerized stream to provide a cracked oligomerized stream. An embodiment of the invention is one, any or all of prior embodiments in this paragraph up through the first embodiment in this paragraph further comprising hydrogenating the second-stage oligomerized olefin stream before cracking the second-stage oligomerized stream. An embodiment of the invention is one, any or all of prior embodiments in this paragraph up through the first embodiment in this paragraph further comprising separating the second-stage oligomerized stream into a light oligomerized stream and a heavy oligomerized stream and cracking the heavy oligomerized stream. An embodiment of the invention is one, any or all of prior embodiments in this paragraph up through the first embodiment in this paragraph further comprising hydrogenating the heavy oligomerized stream before cracking the heavy oligomerized stream. An embodiment of the invention is one, any or all of prior embodiments in this paragraph up through the first embodiment in this paragraph wherein the amount of cracking catalyst is greater than about 5 wt % and the amount of hydroisomerization catalyst is less than about 95 wt %. An embodiment of the invention is one, any or all of prior embodiments in this paragraph up through the first embodiment in this paragraph further comprising separating the cracked oligomerized stream to provide a vaporous cracked oligomerized stream and a liquid cracked oligomerized stream. An embodiment of the invention is one, any or all of prior embodiments in this paragraph up through the first embodiment in this paragraph further comprising stripping the liquid cracked oligomerized stream to provide a green jet stream. An embodiment of the invention is one, any or all of prior embodiments in this paragraph up through the first embodiment in this paragraph further comprising recycling a portion of the green jet stream to the dimerizing step. An embodiment of the invention is one, any or all of prior embodiments in this paragraph up through the first embodiment in this paragraph further comprising stripping the liquid cracked oligomerized stream to provide a heavy drag stream. An embodiment of the invention is one, any or all of prior embodiments in this paragraph up through the first embodiment in this paragraph further comprising cooling and separating the vaporous cracked oligomerized stream to provide a cold vaporous cracked oligomerized stream and a cold liquid cracked oligomerized stream and stripping the cold liquid cracked oligomerized stream with the liquid oligomerized stream.

A second embodiment of the invention is a process for oligomerizing an olefin stream comprising dimerizing the olefin stream with a first-stage oligomerization catalyst to produce a first-stage oligomerized olefin stream; oligomerizing the first-stage oligomerized olefin stream with a second-stage oligomerization catalyst to provide a second-stage oligomerized olefin stream; hydrogenating the second-stage oligomerized olefin stream to provide a hydrogenated oligomerized stream; feeding the oligomerized stream to a hydrocracking reactor, i.e. a jet fuel optimization reactor comprising two catalysts; and cracking and hydroisomerizing the hydrogenated oligomerized stream to provide a cracked oligomerized stream. An embodiment of the invention is one, any or all of prior embodiments in this paragraph up through the second embodiment in this paragraph further comprising separating the second-stage oligomerized olefin stream into a light oligomerized olefin stream and a heavy oligomerized olefin stream and hydrogenating the heavy oligomerized olefin stream. An embodiment of the invention is one, any or all of prior embodiments in this paragraph up through the second embodiment in this paragraph wherein the amount of cracking catalyst in the hydrocracking reactor, i.e., a jet fuel optimization reactor is greater than about 5 wt % and the amount of hydroisomerization catalyst is less than about 95 wt %. An embodiment of the invention is one, any or all of prior embodiments in this paragraph up through the second embodiment in this paragraph further comprising separating the cracked oligomerized stream to provide a vaporous cracked oligomerized stream and a liquid cracked oligomerized stream. An embodiment of the invention is one, any or all of prior embodiments in this paragraph up through the second embodiment in this paragraph further comprising stripping the liquid cracked oligomerized olefin stream to provide a green jet stream. An embodiment of the invention is one, any or all of prior embodiments in this paragraph up through the second embodiment in this paragraph further comprising recycling a portion of the green jet stream to the dimerizing step. An embodiment of the invention is one, any or all of prior embodiments in this paragraph up through the second embodiment in this paragraph further comprising stripping the liquid cracked oligomerized stream to provide a heavy drag stream. An embodiment of the invention is one, any or all of prior embodiments in this paragraph up through the second embodiment in this paragraph further comprising cooling and separating the vaporous cracked oligomerized stream to provide a cold vaporous cracked oligomerized stream and a cold liquid vaporous cracked oligomerized stream and stripping the cold liquid cracked oligomerized stream with the liquid oligomerized stream.

A third embodiment of the invention is a process for oligomerizing an olefin stream comprising dimerizing the olefin stream with a first-stage oligomerization catalyst to produce a first-stage oligomerized olefin stream; oligomerizing the first-stage oligomerized olefin stream with a second-stage oligomerization catalyst to provide a second-stage oligomerized olefin stream; hydrogenating the second-stage oligomerized olefin stream to provide a hydrogenated oligomerized stream; feeding the oligomerized stream to a hydrocracking reactor, i.e. a jet fuel optimization reactor comprising two catalysts; and cracking and isomerizing the hydrogenated oligomerized stream to provide a cracked oligomerized stream. An embodiment of the invention is one, any or all of prior embodiments in this paragraph up through the third embodiment in this paragraph further comprising separating the second-stage oligomerized olefin stream into a light oligomerized olefin stream and a heavy oligomerized olefin stream and hydrogenating the heavy oligomerized olefin stream.

Without further elaboration, it is believed that using the preceding description that one skilled in the art can utilize the present disclosure to its fullest extent and easily ascertain the essential characteristics of this disclosure, without departing from the spirit and scope thereof, to make various changes and modifications of the disclosure and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for oligomerizing an olefin stream comprising:

dimerizing said olefin stream with a first-stage oligomerization catalyst to produce a first- stage oligomerized olefin stream;

oligomerizing said first-stage oligomerized olefin stream with a second-stage oligomerization catalyst to provide a second-stage oligomerized stream;

feeding said oligomerized stream to a jet fuel optimization reactor comprising a cracking catalyst and a hydroisomerization catalyst; and cracking and hydroisomerizing said second-stage oligomerized stream to provide a cracked oligomerized stream.

2. The process of claim 1 further comprising hydrogenating said second-stage oligomerized olefin stream before cracking said second-stage oligomerized stream.

3. The process of claim 1 further comprising separating said second-stage oligomerized stream into a light oligomerized stream and a heavy oligomerized stream and cracking said heavy oligomerized stream.

4. The process of claim 3 further comprising hydrogenating said heavy oligomerized stream before cracking said heavy oligomerized stream.

5. The process of claim 1 wherein the amount of said cracking catalyst is greater than about 5 wt % and the amount of said hydroisomerization catalyst is less than about 95 wt %.

6. The process of claim 1 further comprising separating said cracked oligomerized stream to provide a vaporous cracked oligomerized stream and a liquid cracked oligomerized stream.

7. The process of claim 6 further comprising stripping said liquid cracked oligomerized stream to provide a green jet stream.

8. The process of claim 7 further comprising recycling a portion of said green jet stream to said dimerizing step.

9. The process of claim 7 further comprising stripping said liquid cracked oligomerized stream to provide a heavy drag stream.

10. The process of claim 8 further comprising cooling and separating said vaporous cracked oligomerized stream to provide a cold vaporous cracked oligomerized stream and a cold liquid cracked oligomerized stream and stripping said cold liquid cracked oligomerized stream with said liquid oligomerized stream.

11. A process for oligomerizing an olefin stream comprising:

dimerizing said olefin stream with a first-stage oligomerization catalyst to produce a first-stage oligomerized olefin stream;

oligomerizing said first-stage oligomerized olefin stream with a second-stage oligomerization catalyst to provide a second-stage oligomerized olefin stream;

hydrogenating said second-stage oligomerized olefin stream to provide a hydrogenated oligomerized stream;

feeding said oligomerized stream to a jet fuel optimization reactor comprising a cracking catalyst and a hydroisomerization catalyst; and cracking and hydroisomerizing said hydrogenated oligomerized stream to provide a cracked oligomerized stream.

12. The process of claim 11 further comprising separating said second-stage oligomerized olefin stream into a light oligomerized olefin stream and a heavy oligomerized olefin stream and hydrogenating said heavy oligomerized olefin stream.

13. The process of claim 11 wherein the amount of said cracking catalyst in said jet fuel optimization reactor is greater than about 5 wt% and the amount of said hydroisomerization catalyst is less than about 95 wt%.

14. The process of claim 11 further comprising separating said cracked oligomerized stream to provide a vaporous cracked oligomerized stream and a liquid cracked oligomerized stream.

15. The process of claim 14 further comprising stripping said liquid cracked oligomerized olefin stream to provide a green jet stream.

16. The process of claim 15 further comprising recycling a portion of said green jet stream to said dimerizing step.

17. The process of claim 7 further comprising stripping said liquid cracked oligomerized stream to provide a heavy drag stream.

18. The process of claim 8 further comprising cooling and separating said vaporous cracked oligomerized stream to provide a cold vaporous cracked oligomerized stream and a cold liquid vaporous cracked oligomerized stream and stripping said cold liquid cracked oligomerized stream with said liquid oligomerized stream.

19. A process for oligomerizing an olefin stream comprising:

dimerizing said olefin stream with a first-stage oligomerization catalyst to produce a first- stage oligomerized olefin stream;

oligomerizing said first-stage oligomerized olefin stream with a second-stage oligomerization catalyst to provide a second-stage oligomerized olefin stream;

hydrogenating said second-stage oligomerized olefin stream to provide a hydrogenated oligomerized stream;

feeding said oligomerized stream to a jet fuel optimization reactor comprising a cracking catalyst and a hydroisomerization catalyst; and cracking and isomerizing said hydrogenated oligomerized stream to provide a cracked oligomerized stream.

20. The process of claim 19 further comprising separating said second-stage oligomerized olefin stream into a light oligomerized olefin stream and a heavy oligomerized olefin stream and hydrogenating said heavy oligomerized olefin stream.

* * * * *